US005195321A

United States Patent [19]

Howard

[11] Patent Number: 5,195,321

[45] Date of Patent: Mar. 23, 1993

[54] LIQUID PISTON HEAT ENGINE

[75] Inventor: David L. Howard, Lakewood, Colo.

[73] Assignee: Clovis Thermal Corporation, Lakewood, Colo.

[21] Appl. No.: 845,584

[22] Filed: Mar. 4, 1992

[51] Int. Cl.[5] ..... F02G 1/04

[52] U.S. Cl. ..... 60/525; 60/517; 60/530

[58] Field of Search ..... 60/517, 525, 530

[56] References Cited

U.S. PATENT DOCUMENTS 4,148,195 4/1979 Gerstmann et al. ..... 60/516 X 4,676,066 6/1987 Tailer et al. ..... 60/517

*Primary Examiner*—Allen M. Ostrager

*Attorney, Agent, or Firm*—Donald W. Margolis; Edwin H. Crabtree

[57] ABSTRACT

This heat engine, uses a Stirling cycle design, wherein a cold exchanger section of a cylinder and a hot exchanger section of the same cylinder are attached to an axis in an off-center positioned. The axis is preferably capable of rotation, but in some embodiments may be fixed. When a rotatable axis is used, a liquid acting as a piston moves within a portion of the cylinder against centrifugal force, and is driven by a working gas which is used in the same cylinder. By oscillating the liquid in the cylinder outwardly in the cylinder during a downward, or "power", stroke and inwardly in the cylinder during an upward, or "drag", stroke the center of mass of the liquid in the cylinder provides a greater moment of force during the downward power stroke than during the upward drag stroke. When used with a rotating axis and subjected to heating at a hot exchanger section and to cooling at a cold exchanger section at selected times it produces continuous power producing rotary motion about the axis. The cold exchanger section and the hot exchanger section of the cylinder may be cooled and heated using waste water solar energy, or any other type of exterior cooling and heating source. The engine may include both a top and bottom cylinder on the same axis, or multiple cylinder arrays, and it may also include a plurality of cylinder arrays spaced around and about the same axis.

20 Claims, 5 Drawing Sheets

LIQUID PISTON HEAT ENGINE

BACKGROUND OF THE INVENTION (a) Field of the Invention

This invention relates to a liquid piston heat engine or heat pump using a Stirling cycle engine design and having a multiple cylinder array which is capable of producing rotary motion.

(b) Discussion of Prior Art

In 1816 a Scottish clergyman by the name of Robert Stirling invented a heat engine for a source of mechanical power wherein a gas-filled cylinder is alternately heated and cooled for moving a piston back and forth from one end of the cylinder to the other end of the cylinder. The Stirling engine competed with the steam engine, before both were displaced by the internal combustion engine at the start of the twentieth century. Today a great deal of research is being conducted using the Stirling engine cycle design, not as an engine, but for example as a refrigeration heat pump for refrigerators. Helium, a gas which is inert and nontoxic, is being used in the current Stirling pump research. If the new Stirling engine refrigeration designs are successful the use of ozone depleting chlorofluorocarbons (CFC's) would be eliminated. CFC's used as a refrigerant were introduced in 1931 by DuPont Co. under the trademark Freon. CFC's and substitutes thereof are expensive and are believed to be harmful to our environment.

In the early 1970's Colin D. West, a leading authority on Stirling engine technology, disclosed a Stirling cycle liquid piston engine activated by a heated and cooled gas which could be used as a simple, low cost, heat pump. This Stirling cycle liquid piston design is known as the "Siemens" arrangement. By using a multi-cylinder configuration of this arrangement, which is referred to as a "fluidyne", a system can be designed in which all liquid columns are subject to both gas-pressure as well as gravity. West's work related to Stirling cycle heat engines is well documented in numerous published articles as well as in British Patents 1,487,332; 1,507,678; 1,329,567; 1,568,057; 1,581,748; and 1,581,749.

In Erazo U.S. Pat. No. 4,130,993 and Baer U.S. Pat. No. 4,134,264 variations of the Siemens arrangement using a Stirling heat engine or heat pump are described wherein an oscillating liquid motion in a plurality of cylinders produces rotational motion. The Erazo and Baer engines, when rotated on an axis beyond the centrifugal velocity of the oscillating liquid, and with heating and cooling supplied to the system, the rotary motion of the engines on the axis is sustained. Both of these engines rotate about a concentric axis which is used for rotary power, which is useful for example for generating electricity and the like.

The above mentioned adaptations of the Stirling cycle all have a shortcoming in that their designs provide only a limited surface area on the cylinders which inherently limits heat transfer capability. Also and more importantly none of these known earlier engine designs provide the advantage of using multiple cylinder arrays which are offset from a rotating axis for increased moment force in sustaining rotatable velocity of the system.

None of the above mentioned patents describe or disclose teachings of a unique heat engine or heat pump for producing rotary motion incorporating a Stirling cycle with liquid piston as described herein.

SUMMARY OF THE INVENTION

In view of the foregoing, it is an object of the present invention to provide an improved liquid piston heat engine which is simple in design, inexpensive to manufacture, and which can be used efficiently and economically produce rotary motion as a mechanical power source.

Another object of the present invention is to provide an engine or pump which can be driven by sources of energy such as hot or cold waste water,, hot waste gases, solar energy and the like to produce mechanical motion which can be converted to low cost, clean energy and thereby help reduce dependence on fossil fuels as an energy source.

A further object of the present invention is to provide an engine which can be driven by liquids and gases which are inert, and non-toxic and non-harmful to the environment, and thereby, for example, eliminate the use CFS's which are expensive, and which may have a detrimental effect on the earth's protective ozone layer.

Still another object of the present invention is the incorporation of the Stirling engine design features with the Siemens arrangement to produce an engine that can provide continuous rotary motion using inexpensive exterior heating and cooling source such as waste water and solar energy.

The present invention includes a liquid piston heat engine, which may be used for producing rotary motion. The liquid piston heat engine uses a Stirling cycle heat engine design, wherein a cold exchanger section of a cylinder and a hot exchanger section of the same cylinder are attached to an axis, but positioned off-center with respect to that axis. When used with a rotating axis, a liquid within a portion of the cylinder acts as a piston moves within the bore of the cylinder against the centrifugal field produced by the rotation of the system, and is driven by a working gas which is in the same cylinder. By oscillating the liquid in the cylinder outwardly in the cylinder during a downward power stroke and inwardly during an upward drag stroke, the center of mass of the liquid is further from the axis during the downward power stroke than during the upward drag stroke, thereby providing a greater moment of force during the power stroke, thereby sustaining continuous power producing rotary motion. In order to cause the liquid in the cylinder to thus oscillate, portions of the cylinder are utilized as a cold exchanger section and as a hot exchanger section. The cold exchanger section and the hot exchanger section of the cylinder may be cooled and heated using hot or cold waste water, heated gases, solar energy, or any other type of exterior cooling and heating source.

The engine of the present invention may include both a top and bottom cylinder on a common axis, or multiple cylinder arrays, and embodiments of the engine may include a plurality of cylinders disposed and spaced around and attached to a common axis.

As used herein, the term "cylinder" is used to refer to a fluid containing chamber, and is not limited to any specific geometric shape. While the cylinder shown in the present application are in a generally "J" shape to provide a "trap" for the liquid piston portion, other shapes of cylinders may be used to produce an equivalent result. Even a "straight" cylinder without a trap may be used, for example, in systems which will be caused to experience high revolutions per minute, or large differentials between the temperature at the heat exchanger section and the cold heat exchanger section.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DETAILED DESCRIPTION OF THE PREFERRED EMBODIMENT

Figure 1:
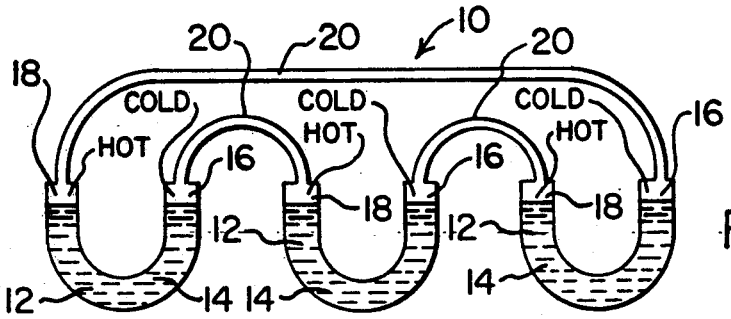
FIG. 1. (PRIOR ART)
FIG. 1 is a front view of a prior art multi-cylinder fluidyne heat engine and known as the Siemens arrangement using the Stirling engine technology but with a liquid piston and a working gas.

Referring to FIG. 1 a front view of a prior art multi-cylinder fluidyne heat pump is illustrated and having a general reference numeral 10. The heat pump 10 includes a series of interconnected "U" shaped cylinders 12 having a liquid piston 14 therein. Disposed inside the cylinders 12 and above the right hand side of the liquid piston 14, is cold gas section 16 where a working gas such as helium is cooled. Likewise above the left hand side of the liquid piston 14, is a hot gas section 18 where the working gas is heated. The cold gas sections 16 and the hot gas sections 18 are connected through the use of regenerator tubes 20. The regenerator tubes 20 act to reduce the inefficiencies which are caused by heating and cooling the working gas in the cylinders 12. By alternately heating and cooling the working gas, the liquid pistons 14 oscillate back and forth in the cylinders 12. This application of a Stirling engine with liquid pistons is called a Siemens arrangement.

Figure 2:
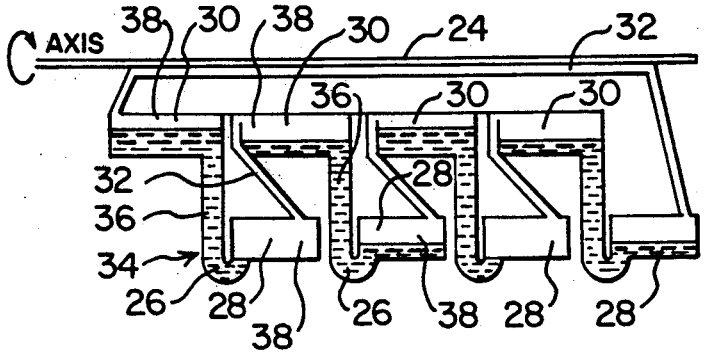
FIG. 2 is a front view of the subject invention having a single cylinder array off-set and rotating about an axis.

In FIG. 2 a front view of the liquid piston heat engine of the present invention is shown having a general reference numeral 22. The heat engine 22 can also be used equally well as a heat pump for refrigeration units and other pump applications, for discussion herein, the subject invention will be referred to as a heat engine for producing mechanical rotary motion. When used as a heat engine, the engine 22 rotates about and is attached to a rotating axis 24. The engine 22 may include a single non-symmetrical cylinder, but in the embodiment shown a plurality of non-symmetrical cylinders 26 are used, with each non-symmetrical cylinder 26 having a cold exchanger section 30 and a hot exchanger section 28. Each of the adjacent cylinders 26 are connected with regenerator tubes 32 for providing greater efficiency when cooling and heating a working gas contained therein. In FIG. 2 the engine 22 is shown to include an array of cylinders having a general reference numeral 34. In this example the cylinder array 34 includes four interconnected non-symmetrical cylinders 26, although any array of two or more cylinders may be used. It should be noted that the array 34 is off-set from the axis 24 rather than being concentric therearound.

In each of the cylinders 26 is a liquid such as water or any other appropriate liquid, with the remaining space in the cylinders filled with an inert gas 38 such as helium. In operation, the liquid acts as a liquid piston 36, and the gas 38 therein acts as a working gas wherein the gas 38 is alternately heated in the hot exchanger section 28 of each cylinder 26, where it is expanded and the gas is subsequently cooled in the cold exchanger section 30 where the gas 38 is caused to compress. The cooling and heating of the working gas 38 in each cylinder 26 causes the liquid piston 36 to oscillate back and forth from the hot exchanger section 28 to the cold exchanger section 30 and then back again. In FIG. 2 the gas 38 is shown without shading. This motion is sustained because the working gas, by oscillating the liquid pistons in the cylinders outwardly during a downward power stroke and oscillating the liquid pistons in the cylinders inwardly during an upward drag stroke cause the center of mass of the liquid of said pistons to be greater during the power stroke than during the drag stroke.

Figure 3:
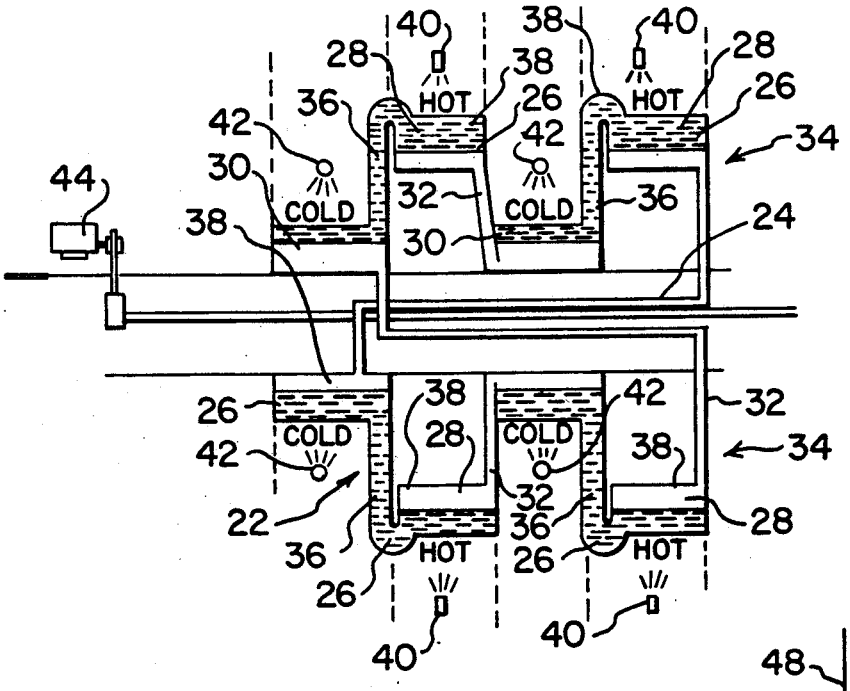
FIG. 3 is a front view of another embodiment of the invention having an upper and lower cylinder array disposed 180 degrees from each other on the rotating axis.

In FIG. 3 the engine 22 is shown with both an upper and lower cylinder array 34. The arrays 34 are attached to the axis 24 and disposed are shown 180 degrees to each other. In this embodiment of the invention, the arrays 34 each include a pair of non-symmetrical cylinders 26 with hot exchanger sections 28 and cold exchanger sections 30. For working the gas 38 in the cylinders 36, an exterior cooling source and heating source is used, such as hot or cold waste water introduced through hot water sprays 40 and cold water sprays 42. When cold water is sprayed it acts to cool and compress the gas 38 in the portion of the cold exchange 30 with which it makes contact, while the hot water is which is sprayed acts to heat and expand the gas 38 in the portion of the heat exchange with which it makes contact. While liquid sprays 40 and 42 are shown in FIG. 3, it can be appreciated that the cylinders 26 could be cooled and heated using water jackets therein, with hot or cold gases, or a variety of other ways. It should also be appreciated that what is now illustrated as a heat exchanger may be a cold exchanger, so long as a sequence of heating one end of liquid piston and cooling the other end is maintained.

Figure 4:
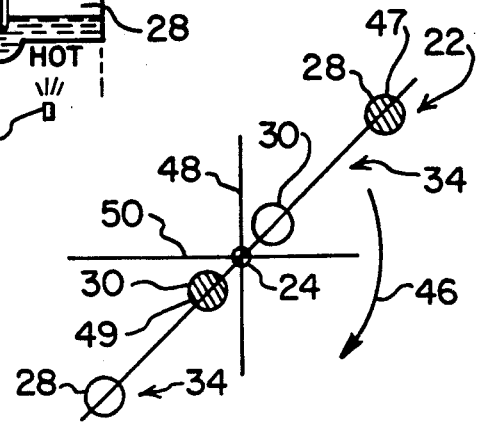
FIG. 4 is an end view of the subject liquid piston heat engine shown in FIG. 3 with the upper cylinder array at a 45 degree position from the vertical or 1:30 o'clock position and the lower cylinder array also at a 45 degree position from the vertical but at a 7:30 o'clock position.

Also shown in FIG. 3 is a start up motor 44 which is used to position one of the cylinder arrays 34 shown in FIG. 3, or the single cylinder array in FIG. 2 at a 45 degree angle from the vertical as shown in FIG. 4. However, once the engine 22 begins to rotate on the axis 24 and the liquid piston 36 begins to oscillate, the motor 44 is disengaged from the axis 24 and the engine 22, so long as it receives the required heating and cooling, is self sustaining in rotating on the axis 24 attached thereto, due to the non-symmetrical structure of the cylinders 36, to thereby provide a source of power. This motion is sustained because the working gas, by oscillating the liquid pistons in the cylinders outwardly during a downward power stroke and oscillating the liquid pistons in the cylinders inwardly during an upward drag stroke cause the center of mass of the liquid of said pistons to be greater during the power stroke than during the drag stroke. When used as a refrigeration heat pump, the movement of the liquid piston will serve to compress the gas and then allow is to expand for cooling purposes.

Figure 8:
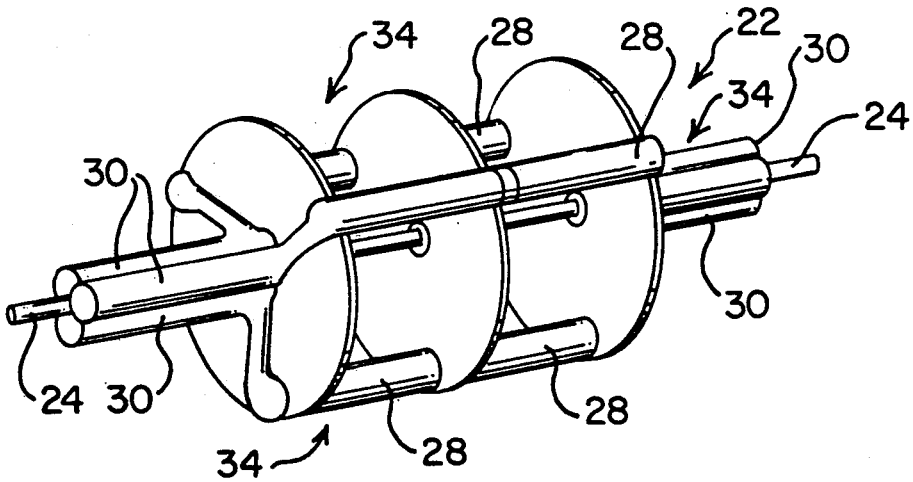
FIG. 8 is a perspective view of the subject liquid piston heat engine with three cylinder arrays attached to a rotating axis and disposed 120 degrees from each other.

By using the Seimans arrangement with liquid piston as shown in FIGS. 1 and 2, no valving is required and the only moving parts are the gas 38, the liquid 36, and the rotating cylinder array 34 on the axis 24. It has been found that when there are multiple arrays 34 as shown in FIG. 8, that liquid piston control is required using valving, solenoids, acoustic speakers, and the like.

In FIG. 4 an end view of the engine 22 as shown in FIG. 3 is illustrated. In this view, the engine 22 is rotating in a clockwise manner as indicated by arrow 46. Also shown is a vertical axis 48 for illustrating a 6:00 clock and a 12:00 clock position during rotation and a horizontal axis 50 for representing a 3:00 clock and a 9:00 clock position. In FIG. 4 the upper cylinder array 34 is in a 1:30 clock position and the lower cylinder array 34 is in a 7:30 clock position. It is important to note that in these positions the majority of the liquid piston 28 in the liquid piston 36 in the upper cylinder array 34 has been purposely cycled into the hot exchanger section 28 so that the center of mass of the liquid shown as a dark shaded circle 47 is cycled outwardly during the downward power stroke of the engine 22. At the same time, the liquid in the liquid piston 30 in the lower cylinder array 34 as been cycled inwardly with the majority of the liquid 36 in the cold exchanger section 30, thereby having a center of mass which is shown as a dark shaded area 49. With the majority of the mass of the liquid in the lower cylinder array 34 thus being positioned as close as possible to the rotating axis 24, the moment of force of the array 34 during the upward drag stroke is reduced.

The mass distribution of the liquid piston 36 in the upper cylinder 34 is illustrated in FIG. 5A through FIG. 5H, and the mass distribution of the liquid piston 36 in the lower cylinder 34 is illustrated in the following FIG. 7A through FIG. 7H, all of which are discussed in greater detail below.

Figure 5A:
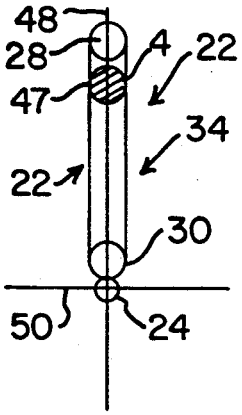
FIG. 5A through FIG. 5H illustrate the position of a liquid center of mass in the upper cylinder as the upper cylinder array rotates from a 12:00 o'clock position, a 1:30 o'clock position, a 3:00 o'clock position, a 4:30 o'clock position, a 6:00 o'clock position, a 7:30 o'clock position, a 9:00 o'clock position, and a 10:30 o'clock position.
Figure 5B:
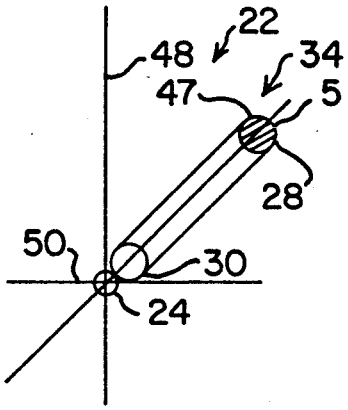
Figure 5C:
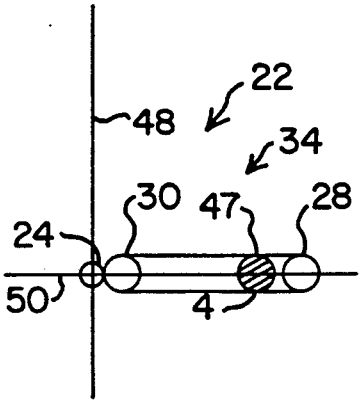
Figure 5D:
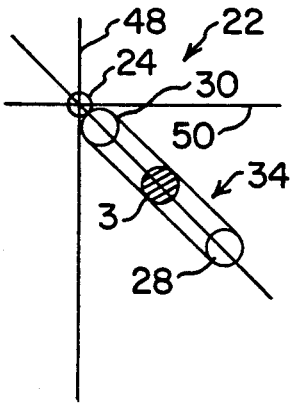
Figure 5E:
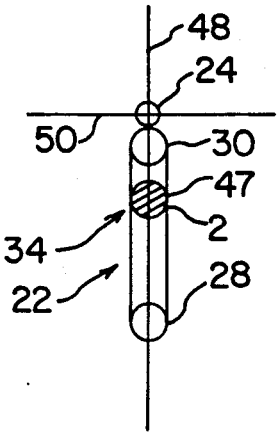

In FIG. 5A the upper cylinder array 34 is shown in a 12:00 clock position with the center of mass 47 of the liquid piston 36 in a 4 position. The number 4 being a numerical value based on a range of positions 1 through 5, with 1 being the closest position to the axis 24 and the 5 position being the further position from the axis 24. In FIG. 5B the center of mass 47 of the liquid piston 36, as the cylinder array 34 starts its downward power stroke, moves to a 5 position or the furthest position from the axis 24. At this 1:30 clock position, the engine 22 has its greatest moment of force as it rotates about the axis 24. In FIG. 5C the upper cylinder array 34 has moved to a 3:00 clock position and the center of mass 47 has moved back to a 4 position. In FIG. 5D the array 34 is now at a 4:30 clock position and the center of mass is now at a 3 position. At the bottom of the power stroke of the engine 22 and at a 6:00 clock position the center of mass 47 of the liquid piston 36 is now at a 2 position as shown in FIG. 5E.

Figure 5F:
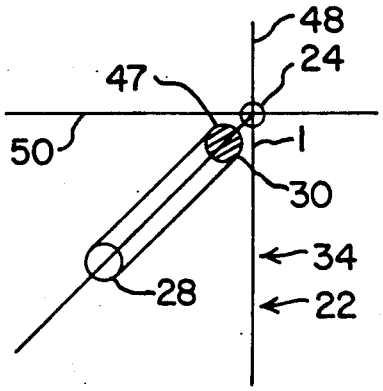
Figure 5G:
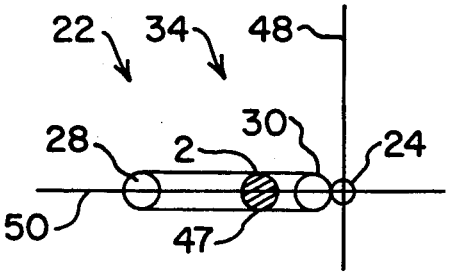
Figure 5H:
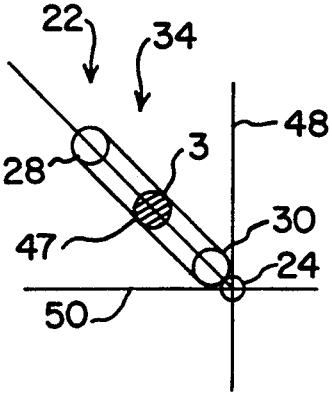

In FIG. 5F the cylinder array 34 has started its rotation upwardly in a drag stroke mode, at a 7:30 clock position, with the center of mass 47 now at a 1 position closest to the axis 24. As the array 34 moves upwardly into a 9:00 clock position shown in FIG. 5G, the center of mass 47 moves to a 2 position. In FIG. 5G the array 34 is now in a 10:30 clock position with the center of mass 47 in a 3 position. The array 34 now completes the drag stroke as it returns to the 12:00 clock position as described with respect to FIG. 5A. This motion is sustained because the working gas, by oscillating the liquid pistons in the cylinders outwardly during a downward power stroke and oscillating the liquid pistons in the cylinders inwardly during an upward drag stroke cause the center of mass of the liquid of said pistons to be greater during the power stroke than during the drag stroke.

Figure 6:
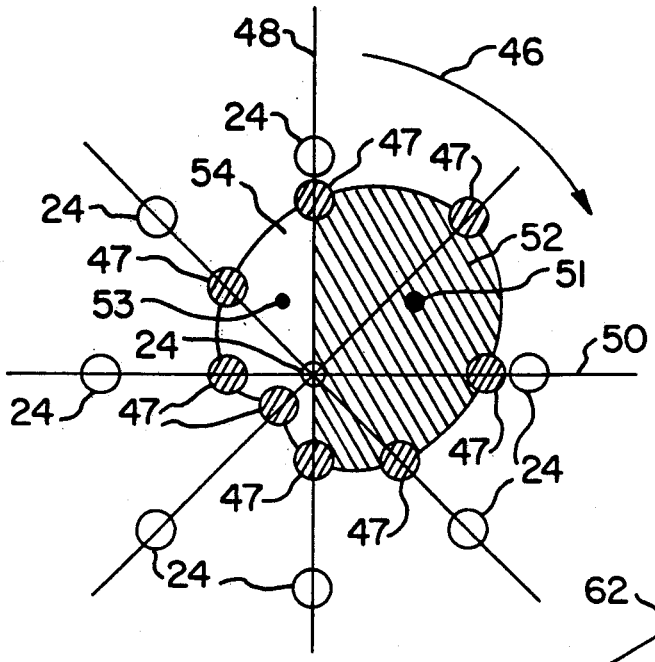
FIG. 6 illustrates a total cycle of the top cylinder rotating 360 degrees with the area of power during the power stroke in dark shading and the area of drag during the drag stroke unshaded.

In FIG. 6 a total cycle of the top cylinder array 34 is shown including each position of center of mass 47 as shown, which coincide with the various positions shown in FIG. 5A through FIG. 5H. By plotting the square unit area of the center of mass 47, in the eight different positions as described above, it is found that the unit area for the center of mass for the power stroke has value of 22 shown as shaded area 52. Likewise the unit area for the center of mass for the drag stroke has a value of 8 and shown as unshaded area 54. The power stroke has been found to have an average moment arm of a value 3 while the drag stroke has an average moment arm of a value 2. Taking these moment of force arm values times their respective unit area for center of mass, we have a value of 16 for the drag stroke and a value for the power stroke of 66 and a total value of 82. By taking 66–16 over 82 it is shown that the top cylinder array 34 has a total power potential of 61% of the liquid mass by properly cycling the liquid piston 36 during the power and drag stroke of the engine 22. In FIG. 6 the overall center of mass of the power stroke is shown as dot 51, with the overall center of mass of the drag stroke is shown as dot 53. Thus the motion is sustained because the working gas, by oscillating the liquid pistons in the cylinders outwardly during a downward power stroke and oscillating the liquid pistons in the cylinders inwardly during an upward drag stroke cause the center of mass of the liquid of said pistons to be greater during the power stroke than during the drag stroke.

Figure 7A:
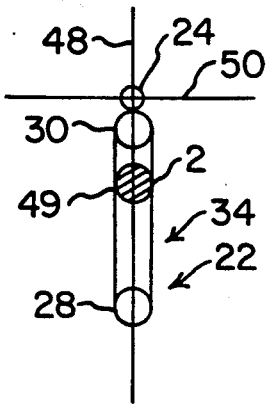
FIG. 7A through FIG. 7H illustrate the position of liquid center of mass in the lower cylinder as the lower cylinder array rotates from a 12:00 o'clock position, a 1:30 o'clock position, a 3:00 o'clock position, a 4:30 o'clock position, a 6:00 o'clock position, a 7:30 o'clock position, a 9:00 o'clock position, and a 10:30 o'clock position.

In FIG. 7A through FIG. 7H eight positions of the lower cylinder array 34 are shown. FIG. 7A the lower cylinder array 34 is at the bottom of the power stroke of the engine 22 and at a 6:00 clock position. The center of mass 49 of the liquid piston 36 is at a 2 position.

Figure 7B:
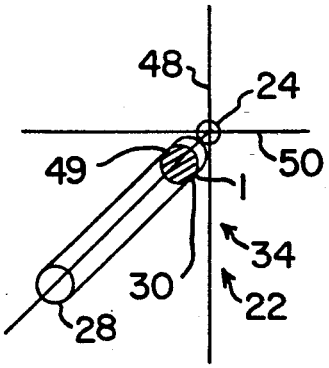
Figure 7C:
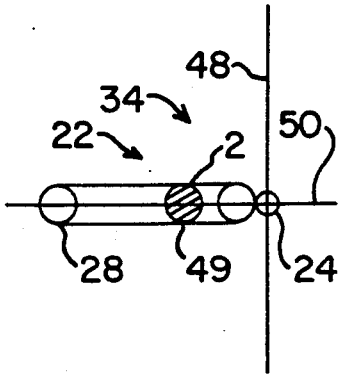
Figure 7D:
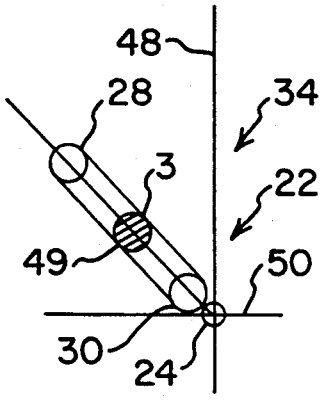
Figure 7E:
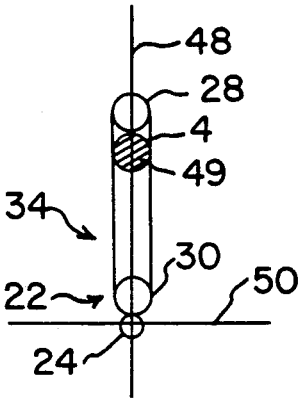

FIG. 7B shows the lower cylinder array 34 moving upward in a drag stroke mode at a 7:30 clock position and the center of mass 49 at a 1 position. In FIG. 7C the array 34 has moved to a 9:00 clock position and the center of mass 49 has now moved to a 2 position. As the array continues to move upwardly in the drag stroke mode to a 10:30 clock position, the center of mass 49 in the array 34 as shown in FIG. 7D has moved to a 3 position. FIG. 7E shows the array 34 at the top of the drag stroke and now in a position to start downwardly into a power stroke. In this 12:00 clock position, the center of mass 49 is in a 4 position.

Figure 7F:
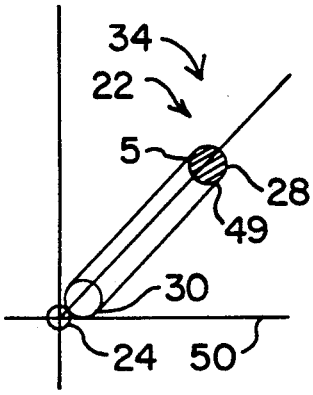
Figure 7G:
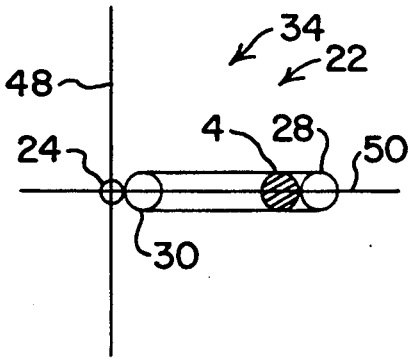
Figure 7H:
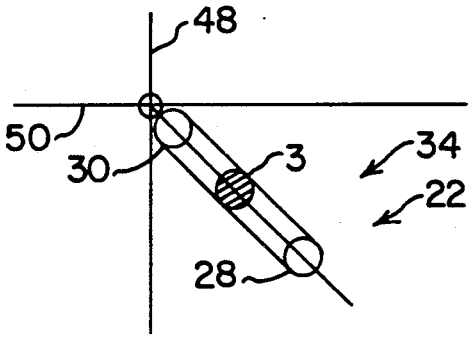

In FIG. 7F the lower cylinder array 34 has started its power stroke and the center of mass 49 at a 1:30 position is at a 5 position. FIG. 7G shows the array 34 at a 3:00 clock position and the center of mass at a 4 position. In the last of the eight positions, the array 34 in FIG. 7H has moved to a 4:30 position and the center of mass 49 is at a 3 position. While a total cycle of the bottom cylinder array 34 is not shown as it is in FIG. 6 with respect to the upper cylinder array 34, it has been found that plotting the center of mass 49 in the lower cylinder array 34 at the eight positions in the rotational cycle is substantially the same as the explanation of center of mass 47 in the upper cylinder array 34. Therefore by properly cycling the liquid piston 36 of the lower cylinder array 34, the total power potential is in the range of 60% or greater. This motion and power is sustained because the working gas, by oscillating the liquid pistons in the cylinders outwardly during a downward power stroke and oscillating the liquid pistons in the cylinders inwardly during an upward drag stroke cause the center of mass of the liquid of said pistons to be greater during the power stroke than during the drag stroke.

In FIG. 8 the heat engine 22 is shown in yet another embodiment with three cylinder arrays 34 equally spaced around the axis 24, with the arrays 120 degrees from one another. As mentioned above the positioning of the liquid piston 36 in the arrays 34 may require sequencing using valves, acoustic speakers, solenoids, heaters and the like, when more than a single cylinder array 34 or an upper and lower array 34 are used. This is necessary to achieve proper oscillation and to achieve the goal of a greater power potential and to assure continuous rotation of the engine 22 and axis 24.

Figure 9:
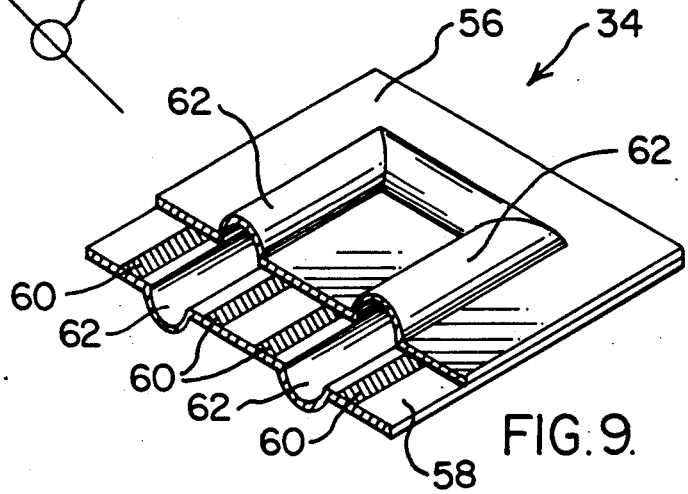
FIG. 9 is a perspective view of a portion of one of the cylinders wherein the cylinder is constructed of a stamped sheet conductive metal such as aluminum or copper. Also nonconductive material such as graphite composites, plastic sheeting, rubber, laminates, and the like may be used in the construction of the cylinders.

FIG. 9 illustrates a cut-away perspective view of a portion of one of the cylinder arrays 34 having a flat plate construction for greater heat transfer. The array 34 in this example is made up of an upper flat plate 56 and a lower flat plate 58 with "U" shaped channels 62 formed therein for circulating the liquid piston 36 and gas 38 therein. The plates 56 and 58 may be made of various materials such as copper sheet, aluminum, rubber, plastic, graphite composite, laminates and like materials. The plates 56 and 58 may be secured together by heat sealing or by a securing agent 60, such as glue, solder, glass paste, and other types of adhesives, and bonding agents. The arrays 34 are formed into a desired shape as shown and filled with a working fluid such as water, water and anti-freeze, and may be inflated with a working gas such as helium, argon, nitrogen and other suitable gases. The advantages of an inflatable cylinder array 34 is that the material and manufacturing costs are low, the manufacturing process is simple, the resulting structure is light weight, and the heat engine 22 can be easily assembled and shaped to a final destination. For example the engine 22 can be fabricated, boxed and shipped from a factory and when delivered to a site, the cylinder arrays 34 filled at its site with the selected working fluid and then inflated with the working gas.

Figure 10:
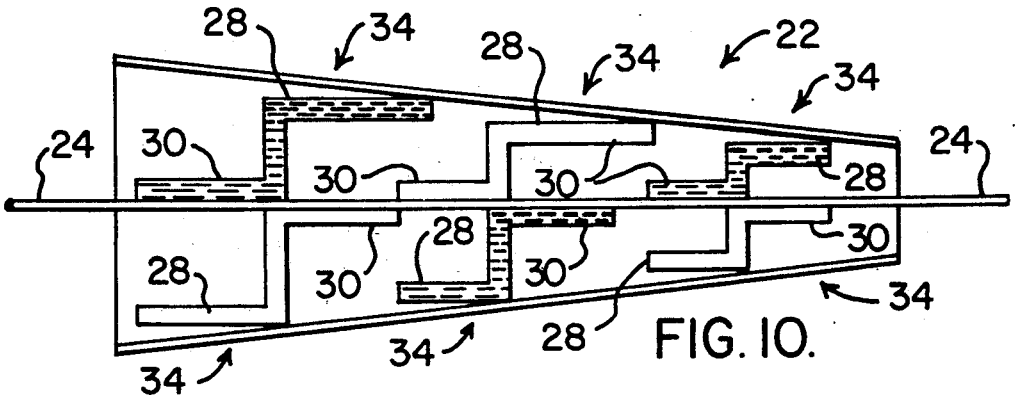
FIG. 10 illustrates an alternate embodiment of the subject invention having a plurality of cylinder arrays of different lengths and sizes for improved temperature differential.

In FIG. 10, yet another configuration of the unique heat engine 22 is shown wherein the length and size of the cylinder arrays is decreased from left to right. By decreasing the size of the arrays 34, the engine 22 is better able to control temperature differential between the cold exchanger sections 30 and the hot exchanger sections 28 of the different cylinder arrays 34 sustain rotation and produce power using the principles and structures of the present invention.

Figure 11:
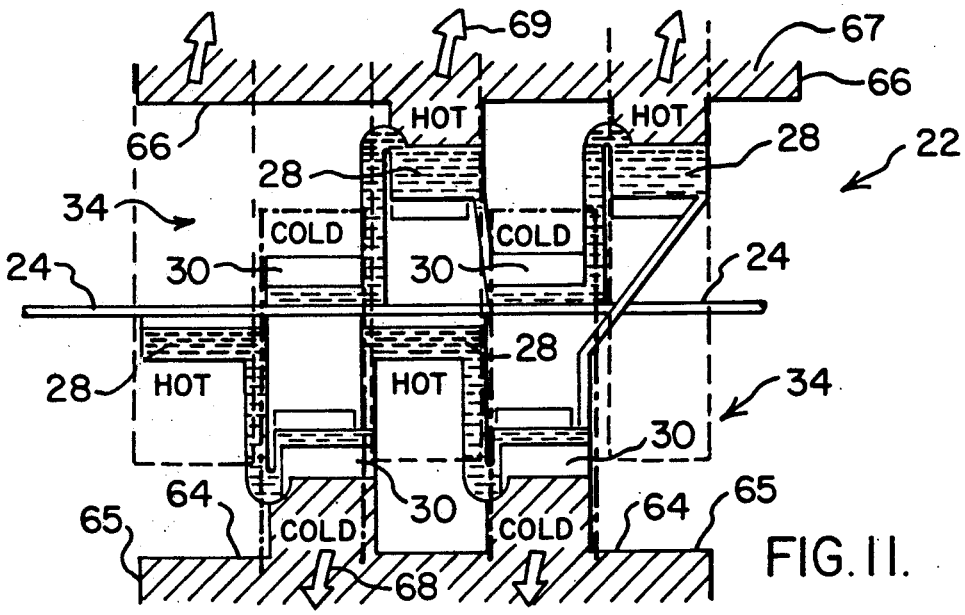
FIG. 11 is a similar view of the subject invention shown in FIG. 3 but used in conjunction with walled partitions for cooling and heating an area.

FIG. 11 illustrates the use of the heat engine 22 as shown in FIG. 3 for external heating or cooling. When the cold exchanger sections 30 passes through a portion of a walled partition 64 sections 28 of the cylinder arrays 34 are used for cooling of an area 65 surrounded by the partition 34, as shown by arrows 68. Likewise the hot exchanger sections 28 can pass through a portion of a walled partition 66 so that the sections 28 can be used for heating an external area 67 surrounded by the partition 66, or simply for the dissipation of the heat into the environment, as shown by arrows 69.

Figure 12:
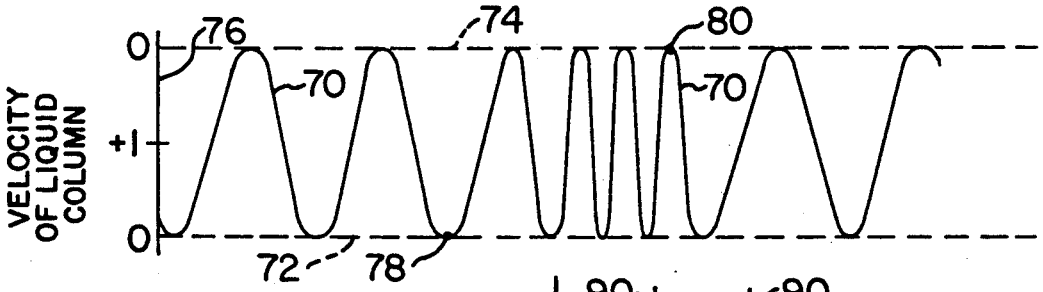
FIG. 12 is a graph of the velocity of the liquid column versus position of the column.

FIG. 12 illustrates a sine wave 70 which is used to represent the oscillating frequency of the liquid piston 36 in one of the cylinder arrays 34. As mentioned under the discussion of FIG. 8, the sequencing of the liquid piston 36 can be accomplished using valves, acoustic speakers, solenoids, electric heaters, and the like. FIG. 12 illustrates such sequencing when an electric heater, not shown, is used inside or outside one of the arrays 34. In such an embodiment the only moving parts in the engine 22 would still be the oscillation of the liquid pistons 36 in the cylinder arrays 34 and the rotation of the engine 22 on the rotating axis 24. Such a heater could be electric, or activated by microwave or inductance which would eliminate the need to have to install electrical contacts inside the arrays 34.

Referring again to FIG. 12, a horizontal dashed line 72 represents a bottom or 6:00 clock position of the liquid piston 36 while a horizontal dashed line 74 represents a top or 12:00 clock position of the piston 36. A vertical line 76 represents a velocity of the piston 36 as it oscillates in the cylinder array 34. At point 78 on the sine wave 70, the heater is activated and the normal wave frequency is accelerated so that the modulation of the liquid column can be changed as the sine wave 70 moves from left to right. At point 80 on the sine wave 70, the electric heater is turned off and the liquid piston 36 now "coasts" into a desired position. By using the heater, the phase of the liquid pistons 36, oscillating in the cylinder arrays 34, can easily be changed so that proper synchronization is obtained for optimal performance of the heat engine 22. The use of fuzzy logic based calculations would be helpful in controlling such a sequence.

Figure 13:
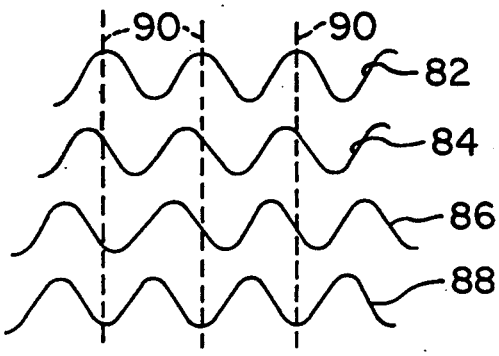
FIG. 13 is an illustration of the frequency phase of the four different cylinder arrays.

FIG. 13 illustrates the frequency phase of four different cylinder arrays 34. The first cylinder array 34 is shown as sine wave 82, while the second, third, and fourth arrays 34 are shown as sine waves 84, 86, and 88, respectively. The distance between vertical dashed lines 90 represent a full 360 degree cycle of the rotating heat engine 22. As represented in FIG. 13, the liquid piston 34 of the first array 34 is shown at a 12:00 clock position when the top of the sine wave 82 crosses the dashed lines 90. At the same time the first array 34 is at a 12:00 clock position, the liquid piston 36 of the second array 34 is shown at a 2:00 clock position as represented by the sine wave 84. Likewise the liquid piston 34 of the third array 34 is shown by its sine wave 86 at a 4:00 clock position, and the liquid piston 36 of the fourth array 34 is shown by its sine wave 88 at the bottom of the frequency curve at a 6:00 clock position when the first array 34 is at the 12:00 clock position.

Once the liquid pistons 36 of the cylinder arrays 34 are optimized as to proper phase frequency, as shown in FIG. 13, the heat engine 22 should not require further input from the electric heater, while the engine 22 is running during normal operation. The heater would only be required during start-up. If one of the cylinder arrays has a liquid piston that is out of phase, for example with its gas pressure different than the pressure in the other cylinder arrays 34, then the electric heater could be used to correct the piston that is out of phase. With proper quality control during manufacturing of the engine 22 and careful control of the liquids and gases during the installation and start-up of the engine 22, the problem of unsynchronized phase frequency of the cylinder arrays 34 will be kept to a minimum. Also the frequency of the liquid pistons 36 can be monitored by a microprocessor. Any array 34 that is a continuous problem could be replaced.

While the above discussed unique heat engine 22 has been discussed as an engine for rotating an axis and developing mechanical and electrical energy, it should be kept in mind that the cylinder arrays 34 as shown in FIGS. 2 and 3, could be used as stationary heat pumps. By this, the arrays 34, unlike the Siemans design shown in FIG. 1, have an increased surface area for improved heat transfer. Also a stationary heat engine, using the Stirling liquid piston design, would have better heat transfer than conventional refrigerators using a liquid/-gas phase operation. Still further the use of the Stirling liquid piston with increase heat transfer properties, would not require the utilization of chlorofluorocarbons.

While the invention has been particularly shown, described and illustrated in detail with reference to preferred embodiments and modifications thereof, it should be understood by those skilled in the art that the foregoing and other modifications are exemplary only, and that equivalent changes in form and detail may be made therein without departing from the true spirit and scope of the invention as claimed, except as precluded by the prior art.

The embodiments of the invention for which an exclusive privilege and property right is claimed are defined as follows:

1. A liquid piston heat engine having a Stirling cycle heat engine design incorporated therein, the engine comprising:

an axis;

a hollow cylinder attached to and positioned off-center from said axis, said cylinder having a closed inner compartment, including a cold exchanger section and a hot exchanger section therein;

a liquid which is capable of acting as a piston disposed in said closed inner compartment of said cylinder;

a working gas disposed in said closed inner compartment of said cylinder for driving said liquid alternately from said cold exchanger section to said hot exchanger section and back to said cold exchanger section;

means for cooling said cold exchanger section; and means for heating said hot exchanger section; whereby said working gas oscillates said liquid in said closed inner compartment of said cylinder outwardly during a downward power stroke and oscillates said liquid in said closed inner compartment of said cylinder inwardly during an upward drag stroke, so that the center of mass of the liquid in the cylinder provides a greater moment of force during the downward power stroke than during the upward drag stroke.

2. The engine as described in claim 1 wherein said axis is designed and mounted for rotation.

3. The engine as described in claim 1 wherein said cooling means provides substantially continuous cooling and said heating means provides substantially continuous heating.

4. The engine as described in claim 1 wherein said cooling includes a plurality of cold exchanger sections and a plurality of hot exchanger sections thereby forming a cylinder array.

5. The engine as described in claim 2 wherein the engine includes an upper cylinder and a lower cylinder attached to and positioned off-center from the rotating axis, said upper and lower cylinders each including a cold exchanger section and a hot exchanger section.

6. The engine as described in claim 5 wherein said upper cylinder and said lower cylinder includes a plurality of cold exchanger sections and hot exchanger sections making up an upper cylinder array and a lower cylinder array.

7. The engine as described in claim 2 wherein the engine includes a plurality of cylinders attached to and positioned off-center from the rotating axis, said cylinders having a plurality of cold exchanger sections and hot exchanger sections making up a plurality of cylinder arrays.

8. The engine as described in claim 6 further including means for synchronizing the oscillation of said liquid piston in said cylinder arrays during the power stroke and drag stroke.

9. The engine as described in claim 8 wherein said means for synchronizing the oscillation of said liquid piston in said cylinder arrays is selected from the group consisting of valving, acoustic speakers, solenoids, and heaters.

10. The engine as described in claim 1 wherein said means for continuously cooling said cold exchanger section is relatively cooler waste water.

11. The engine as described in claim 1 wherein said means for continuously heating said hot exchanger section is relatively hotter waste water.

12. The engine as described in claim 1 further including a regenerator attached to said cylinder and connected between said cold and hot exchanger sections.

13. A liquid piston heat engine for producing rotary motion about a rotating axis, the engine using a Stirling cycle heat engine design incorporated therein, the engine comprising:

a cylinder attached to and positioned off-center from the rotating axis, said cylinder having a plurality of cold exchanger sections and hot exchanger sections making up a cylinder array;

a plurality of regenerators attached to said cylinder, said regenerators connected between each of said cold and hot exchanger sections;

a liquid acting as a piston disposed in a portion of each of said cold exchanger section and in a portion of each of said hot exchanger section of said cylinder array;

a working gas disposed on opposite sides of said piston and in each cold exchanger section and each hot exchanger section of said cylinder array;

means for continuously cooling said cold exchanger section; and means for continuously heating said hot exchanger section, whereby said working gas by oscillating said piston in said cylinder array outwardly during a downward power stroke and oscillating said piston in said cylinder array during an upward drag stroke, maintain the center of mass of said liquid acting as the piston is greater during the power stroke than the during drag stroke.

14. The engine as described in claim 13 further including an upper cylinder and a lower cylinder attached to and positioned off-center from the rotating axis, said upper and lower cylinders each having a plurality of cold exchanger sections and a plurality of hot exchanger sections making up upper and lower cylinder arrays.

15. The engine as described in claim 13 further including a plurality of cylinders attached to and positioned off-center from the rotating axis, said cylinders having a plurality of cold and hot exchanger sections making up cylinder arrays.

16. The engine as described in claim 15 further including means for synchronizing the oscillation of said liquid pistons in said cylinder arrays during the power stroke and during the drag stroke.

17. The engine as described in claim 16 wherein said means for synchronizing the oscillation of said liquid pistons in said cylinder arrays is selected from the group consisting of valving, acoustic speakers, solenoids, and heaters.

18. The engine as described in claim 13 further including a walled partition disposed around a portion of said cold exchanger sections for providing external cooling.

19. The engine as described in claim 13 further including a walled partition disposed around a portion of said hot exchanger sections for providing external heating.

20. A liquid piston heat engine for producing rotary motion about a rotating axis and for producing a power output, the engine using a Stirling cycle heat engine design with Siemens arrangement incorporated therein, the engine comprising:

a plurality of cylinders attached to and positioned off-center from the rotating axis, said cylinders having cold exchanger sections and hot exchanger sections therein;

a liquid acting as a piston disposed in a portion of each of said cold exchanger sections and hot exchanger sections:

a working gas disposed on both sides of said liquid piston for driving said liquid piston alternately from each of said cold exchanger sections to each of said hot exchanger sections and back to said cold exchanger sections;

means for continuously cooling said cold exchanger sections; means for continuously heating said hot exchanger sections; whereby said working gas by oscillating said liquid pistons in said cylinders outwardly during a downward power stroke and oscillating said liquid pistons in said cylinders inwardly during an upward drag stroke, cause the center of mass of the liquid of said pistons to be greater during the power stroke than during the drag stroke.

* * * * *